US006094779A

United States Patent [19]

Young

[11] Patent Number: 6,094,779

[45] Date of Patent: Aug. 1, 2000

[54] ROLLER BRACKET APPARATUS FOR AN OVERHEAD DOOR

[76] Inventor: James Richard Young, 3881 Amador Way, Reno, Nev. 89502

[21] Appl. No.: 09/140,230

[22] Filed: Aug. 26, 1998

Related U.S. Application Data

[63] Continuation-in-part of application No. 08/656,926, Jun. 3, 1996, Pat. No. 5,799,368.

[51] Int. Cl.[7] ..... E05D 15/06; E05F 11/00

[52] U.S. Cl. ..... 16/92; 49/199; 49/198; 160/201; 160/209

[58] Field of Search ..... 16/97; 160/201, 160/209; 49/197, 198, 199

[56] References Cited

U.S. PATENT DOCUMENTS

| | | | |
|---|---|---|---|
| 4,115,900 | 9/1978 | Mihalcheon | 160/209 |
| 5,572,829 | 11/1996 | Stoltenberg | 49/200 |
| 5,664,372 | 9/1997 | Williams et al. | 49/199 |
| 5,743,046 | 4/1998 | Siegler et al. | 49/199 |
| 5,768,828 | 6/1998 | Wilson | 49/197 |
| 5,803,149 | 9/1998 | Halley et al. | 160/201 |
| 5,921,307 | 7/1999 | Ford et al. | 160/201 |

*Primary Examiner*—Anthony Knight
*Assistant Examiner*—Vishal Patel

[57] ABSTRACT

A roller bracket apparatus includes a roller assembly which includes a carriage portion and a link portion projecting from the carriage portion. A push/pull assembly is provided, and a pivot assembly is connected between the link portion of the roller assembly and the push/pull assembly. The carriage portion includes a wheel-support portion and a plurality of axle/wheel assemblies supported by the wheel-support portion. Each of the axle/wheel assemblies includes an axle and a roller wheel connected to the axle. The link portion extends from the carriage portion at an acute angle with respect to a plane common to the top surface of the carriage portion. In an alternatively preferred embodiment of the invention, the push/pull assembly includes a first side portion connected to the article being moved (e.g. an overhead door panel) and an integrated gusset plate portion orthogonally connected between the first side portion and the pivot assembly. The push/pull assembly further includes a transverse angled bearing surface portion orthogonally joined to the gusset plate portion in such a way as to be adapted to engage the link portion and be stopped thereby at the limit of rotation of the push/pull assembly when the latter's first side portion becomes horizontally aligned to the roller assembly during its movement along a horizontal portion of track along which the article ultimately moves.

10 Claims, 5 Drawing Sheets

FIG 2
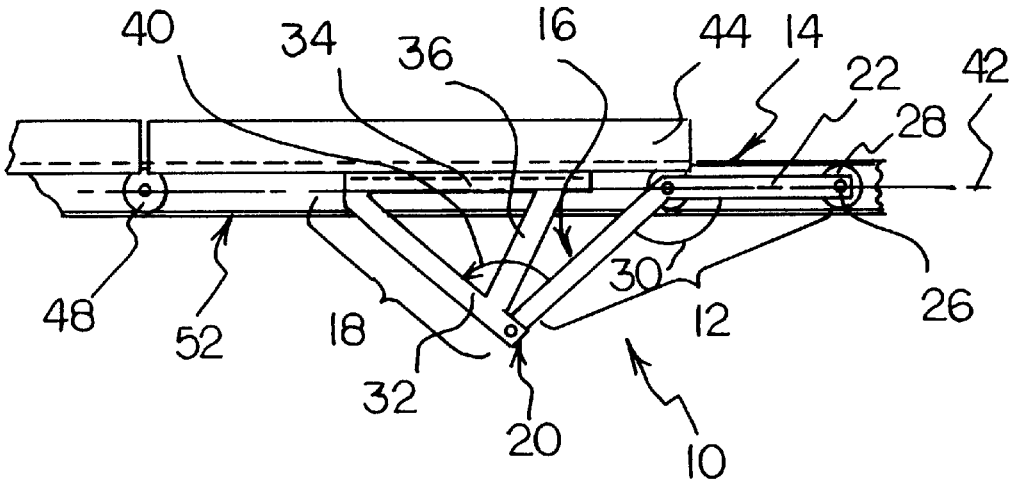
FIG 3
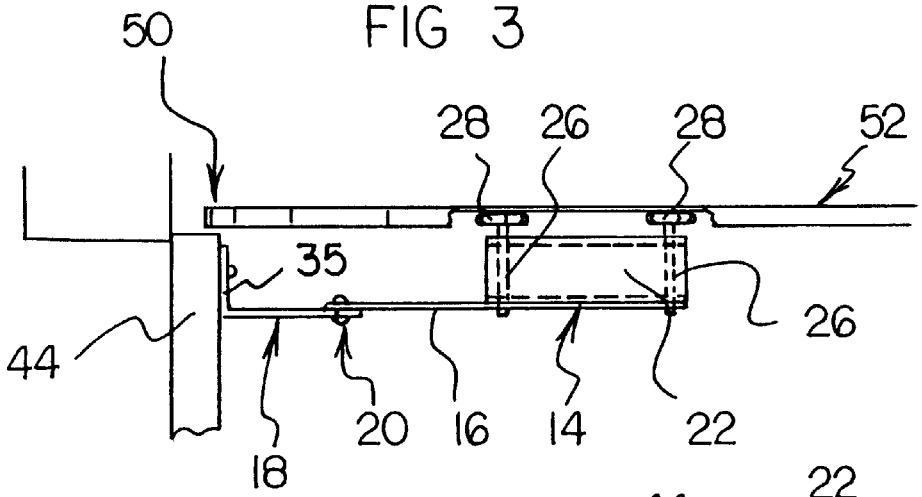
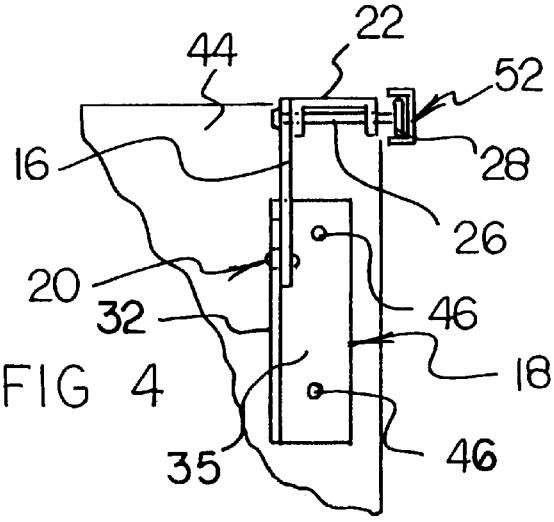
FIG 4

FIG 7
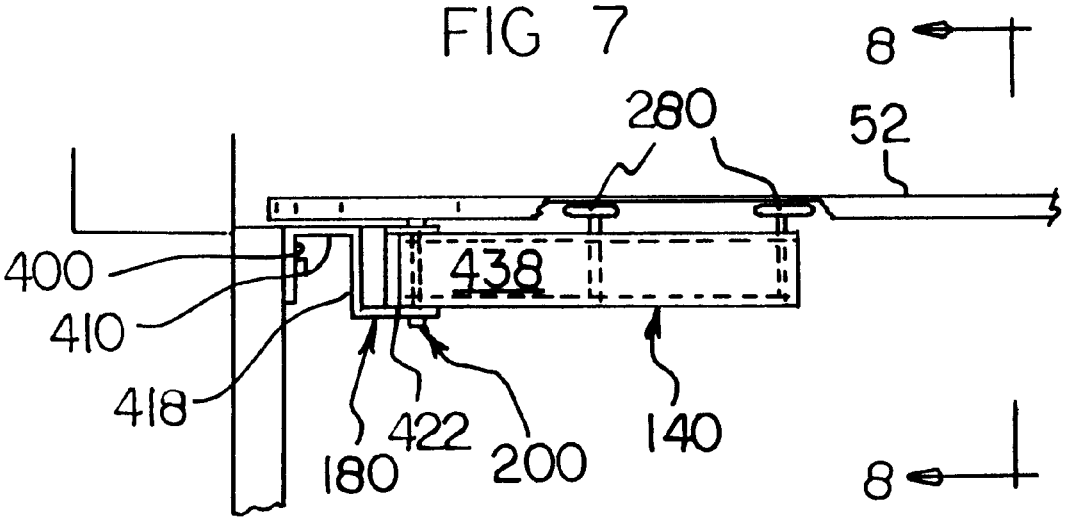
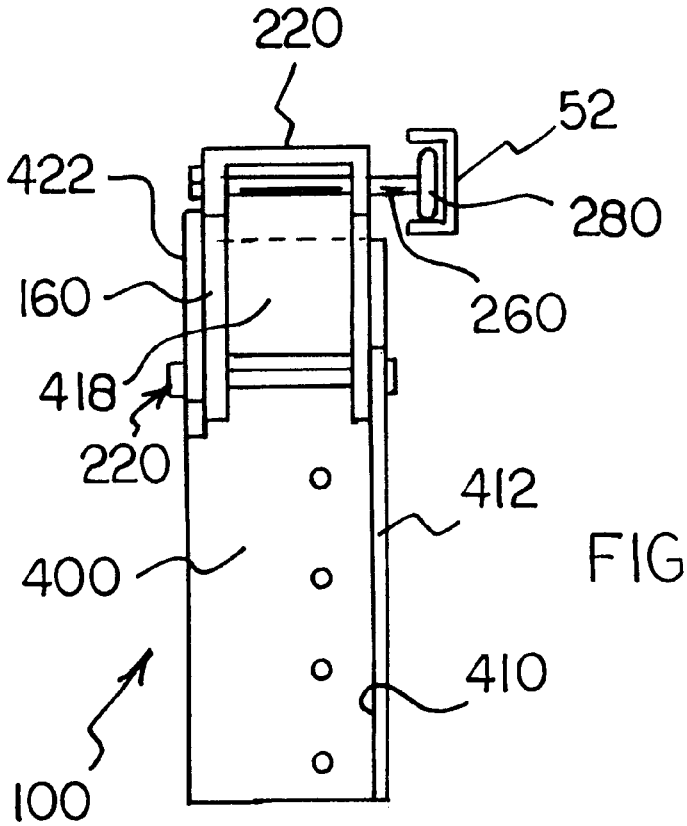
FIG 8

ROLLER BRACKET APPARATUS FOR AN OVERHEAD DOOR

RELATED APPLICATION

The present application is a continuation-in-part of my prior co-pending application, Ser. No. 08/656,926, filed Jun. 3, 1996, now U.S. Pat. No. 5,799,368.

BACKGROUND OF THE INVENTION

1. Field of the Invention

The present invention relates generally to overhead doors and, more particularly, to brackets for retaining rollers for a top panel in an overhead door.

2. Description of the Prior Art

Overhead doors are well known. Especially common are sectional, roll up doors that employ a pair of tracks for rollers. Each track has a vertical portion for retaining door panels in a vertical or closed orientation (door "down"), and each track has a horizontal portion for retaining door panels in a horizontal or open orientation (door "up"). In the area of overhead doors, the concept of headroom relates to the space above a closed door that is required for retaining the horizontal portions of the tracks. Moreover, the headroom space retains the overhead door when the overhead door is in an open or horizontal orientation. For optimum action, many conventional overhead doors require a headroom space that has a height of twelve inches. However, due to construction of a structure, such as a garage, often less than a standard height of twelve inches is allowed for the headroom space.

When less than twelve inches of headroom space are provided, several alternatives are known. One such alternative is the provision of what are known as low headroom tracks which require only six inches height for headroom space. However, such low headroom tracks are expensive and excessively time consuming to install. In this respect, it would be desirable if a device were provided for an overhead door that does not use low headroom tracks.

Another alternative to having a twelve inch height for a headroom space is to cut several inches from the bottom of the vertical portions of the roller tracks. In this way, the horizontal portions of the tracks would be lowered. When this is done, known substitute top brackets need to be installed at the two top corners of the door. Such known substitute top brackets are disclosed in U.S. Pat. No. 4,095,641 and may not perform as well as intended. In this respect, it would be desirable if a device were provided for an overhead door that does not employ known top brackets that are employed with overhead doors for which several inches have been cut from the bottoms of vertical portions of the roller tracks.

As discussed above, provisions are made in the prior art for a vertical height of headroom space to be in a range of six to twelve inches. However, there are applications that may call for a vertical height of headroom space to be less than six inches. In this respect, it would be desirable if a device were provided for an overhead door that permits a vertical height for headroom space to be less than six inches. Moreover, there may also be applications in which it would be desirable for the vertical height of headroom space to be no higher than the vertical distance required by the horizontal portions of roller tracks.

Aside from U.S. Pat. No. 4,095,641 mentioned above, throughout the years, a number of innovations have been developed relating to overhead doors, and the following U.S. patents are representative of some of those innovations: U.S. Pat. Nos. 4,878,529, 5,042,556, 5,135,040, 5,235,724, and Des. 337,042. More specifically, U.S. Pat. No. 4,878,529 discloses an overhead door that has door-pulling gear located above the horizontal portions of roller tracks. Consequently, a relatively large vertical height is needed for the headroom space. In this respect, it would be desirable if a device were provided for an overhead door that does not include door-pulling gear located above the horizontal portions of roller tracks.

Each of U.S. Pat. Nos. 5,042,556 and 5,135,040 discloses an overhead door that includes a pair of stationary corner wheels that change vertical to horizontal motion for the door panels. It would be desirable to avoid the installation and the expense of such direction-changing stationary corner wheels. In this respect, it would be desirable if a device were provided for an overhead door that avoids the use of stationary, direction-changing corner wheels.

U.S. Pat. No. 5,235,724 may be of interest for its disclosure of a roller-hinge assembly for a retractable overhead door. U.S. Pat. No. Des. 337,042 may be of interest for its disclosure of an angled bracket for overhead garage doors.

Thus, while the foregoing body of prior art indicates it to be well known to use overhead doors with headroom spaces whose vertical height is less than twelve inches, the prior art described above does not teach or suggest a roller bracket apparatus for an overhead door which has the following combination of desirable features: (1) does not use low headroom tracks; (2) does not employ known top brackets that are employed with overhead doors for which several inches have been cut from the bottoms of vertical portions of the roller tracks; (3) permits a vertical height for headroom space to be less than six inches; (4) permits the vertical height of headroom space to be no higher than the vertical distance required by the horizontal portions of roller tracks; (5) does not include door-pulling gear located above the horizontal portions of roller tracks; and (6) avoids the use of stationary, direction-changing corner wheels. The foregoing desired characteristics are provided by the unique roller bracket apparatus for an overhead door of the present invention as will be made apparent from the following description thereof. Other advantages of the present invention over the prior art also will be rendered evident.

SUMMARY OF THE INVENTION

To achieve the foregoing and other advantages, the present invention, briefly described, provides a roller bracket apparatus which includes a roller assembly which includes a carriage portion and a link portion projecting from the carriage portion. A push/pull assembly is provided, and a pivot assembly is connected between the link portion of the roller assembly and the push/pull assembly. The carriage portion includes a wheel-support portion and a plurality of axle/wheel assemblies supported by the wheel-support portion. Each of the axle/wheel assemblies includes an axle and a roller wheel connected to the axle.

The link portion extends from the carriage portion at an oblique extension angle. The push/pull assembly includes a first side connected to the pivot assembly, and a second side is connected to the first side. The push/pull assembly also includes a third side connected between the first side and the second side. The first side of the push/pull assembly is oriented with respect to the link portion of the roller assembly substantially in a straight line when the second side of the push/pull assembly is oriented with respect to the wheel-support portion of the roller assembly at a right angle.

On the other hand, the first side of the push/pull assembly is oriented with respect to the link portion of the roller assembly in an oblique link-to-first-side orientation angle when the second side of the push/pull assembly is oriented with respect to the wheel-support portion of the roller assembly in a straight line. The link-to-first-side orientation angle is less than the oblique extension angle.

In an alternatively preferred embodiment of the invention, the push/pull assembly includes a first side portion connected to the article being moved (e.g. an overhead door panel) and an integrated gusset plate portion orthogonally connected between the first side portion and the pivot assembly. The push/pull assembly further includes a transverse angled bearing surface portion orthogonally joined to the gusset plate portion in such a way as to be adapted to engage the link portion and be stopped thereby at the limit of rotation of the push/pull assembly when the latter's first side portion becomes horizontally aligned to the roller assembly during its movement toward and along a horizontal portion of track along which the article ultimately moves.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roller bracket apparatus for an overhead door which has all of the advantages of the prior art and none of the disadvantages.

It is another object of the present invention to provide a new and improved roller bracket apparatus for an overhead door which may be easily and efficiently manufactured and marketed.

It is a further object of the present invention to provide a new and improved roller bracket apparatus for an overhead door which is of durable and reliable construction.

An even further object of the present invention is to provide a new and improved roller bracket apparatus for an overhead door which is susceptible of a low cost of manufacture with regard to both materials and labor, and which accordingly is then susceptible of low prices of sale to the consuming public, thereby making such roller bracket apparatus for an overhead door available to the buying public.

Still yet a further object of the present invention is to provide a new and improved roller bracket apparatus for an overhead door which does not use low headroom tracks.

Still another object of the present invention is to provide a new and improved roller bracket apparatus for an overhead door that does not employ known top brackets that are employed with overhead doors for which several inches have been cut from the bottoms of vertical portions of the roller tracks.

Yet another object of the present invention is to provide a new and improved roller bracket apparatus for an overhead door which permits a vertical height for headroom space to be less than six inches.

Even another object of the present invention is to provide a new and improved roller bracket apparatus for an overhead door that permits the vertical height of headroom space to be no higher than the vertical distance required by the horizontal portions of roller tracks.

Still a further object of the present invention is to provide a new and improved roller bracket apparatus for an overhead door which does not include door-pulling gear located above the horizontal portions of roller tracks.

Yet another object of the present invention is to provide a new and improved roller bracket apparatus for an overhead door that avoids the use of stationary, direction-changing corner wheels.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 2 is a side view showing the embodiment of the invention of FIG. 1, showing more of the horizontal portion of the roller track, in a position wherein the overhead door is in either a partially or fully open position.

FIG. 3 is a top view of the embodiment of the invention shown in FIG. 1 taken along line 3—3 thereof.

FIG. 4 is a cross-sectional view of the embodiment of the invention shown in FIG. 1 taken along line 4—4 thereof.

FIG. 7 is a top view of the alternatively preferred embodiment of the invention shown in FIG. 5 thereof.

FIG. 8 is an end view of the alternatively preferred embodiment of the invention shown in FIG. 7 taken along line 8—8 thereof.

DESCRIPTION OF THE PREFERRED EMBODIMENT

Figure 1:
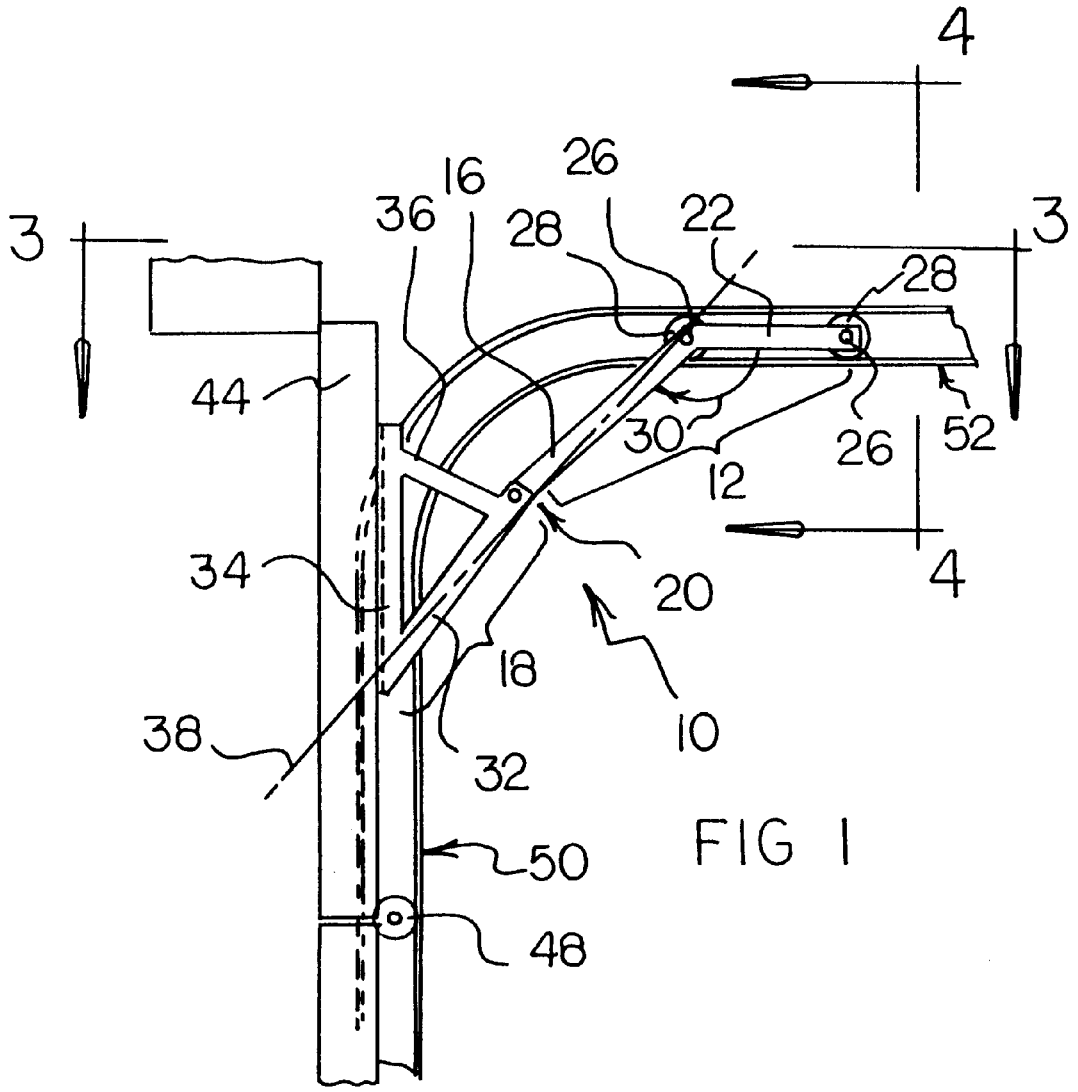
FIG. 1 is a side view showing a first preferred embodiment of the roller bracket apparatus for an overhead door of the invention in a position wherein the overhead door is in a fully closed position.
Figure 5:
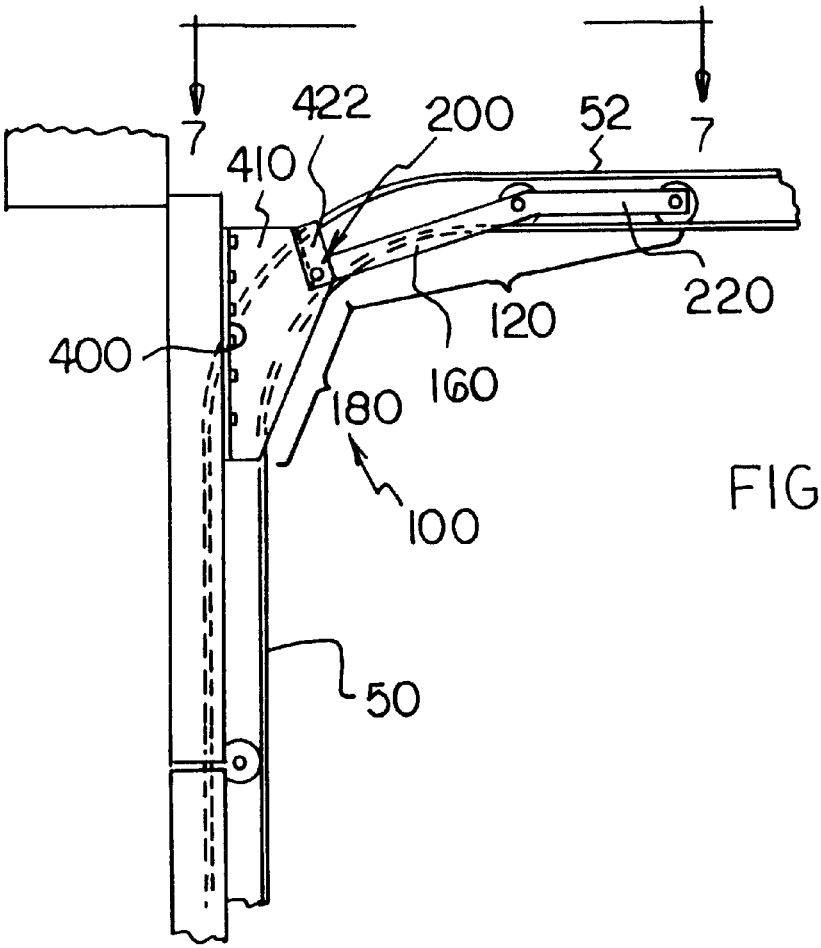
FIG. 5 is a side view showing an alternatively preferred embodiment of the roller bracket apparatus for an overhead door of the invention in a position wherein the overhead door is in a fully closed or "down" position.

With reference to the drawings, a new and improved roller bracket apparatus for an overhead door embodying the principles and concepts of the present invention will be described.

Turning initially to FIGS. 1–4, there is shown a first exemplary embodiment of the roller bracket apparatus for an overhead door of the invention generally designated by reference numeral 10. In its preferred form, roller bracket apparatus 10 includes a roller assembly 12 which includes a carriage portion 14 and a link portion 16 projecting from the carriage portion 14. A push/pull assembly 18 is provided, and a pivot assembly 20 is connected between the link portion 16 of the roller assembly 12 and the push/pull assembly 18. The carriage portion 14 includes a wheel-support portion 22 and a plurality of axle/wheel assemblies supported by the wheel-support portion 22. Each of the axle/wheel assemblies includes an axle 26 and a roller wheel 28 connected to the axle 26.

The link portion 16 extends from the carriage portion 14 at an oblique extension angle 30. The push/pull assembly 18 includes a first side 32 connected to the pivot assembly 20, and a second side 34 is connected to the first side 32. The push/pull assembly 18 also includes a third side 36 connected between the first side 32 and the second side 34. The first side 32 of the push/pull assembly 18 is oriented with respect to the link portion 16 of the roller assembly 12 substantially in a straight line 38 when the second side 34 of the push/pull assembly 18 is oriented with respect to the wheel-support portion 22 of the roller assembly 12 at a right angle (FIG. 1).

On the other hand, the first side 32 of the push/pull assembly 18 is oriented with respect to the link portion 16 of the roller assembly 12 in an oblique link-to-first-side orientation angle 40 when the second side 34 of the push/pull assembly 18 is oriented with respect to the wheel-support portion 22 of the roller assembly 12 in a straight line 42 FIG. 2). The link-to-first-side orientation angle 40 is less than the extension angle 30.

In using the roller bracket apparatus 10 of the invention, the second side 34 of the push/pull assembly 18 preferably is in the form of a right angle having a flat plate portion 35 which is connected to a top panel 44 of an overhead door using suitable fasteners such as screws 46 (FIG. 4). Rollers 48 are provided between adjacent panels in the overhead door. The rollers 48 connected to the panels and the roller wheels 28 of the roller assembly 12 of the invention ride in a track which includes a vertical track portion 50 and a horizontal track portion 52.

As shown in FIG. 1, the overhead door is closed (i.e. fully "down") and the top panel 44 is in a vertical orientation. When the overhead door is down, the wheel-support portion 22 of the roller assembly 12 is in the horizontal track portion 52, the second side 34 of the push/pull assembly 18 and the wheel-support portion 22 of the roller assembly 12 are oriented with respect to each other at a right angle, and the first side 32 of the push/pull assembly 18 and the link portion 16 of the roller assembly 12 are oriented with respect to each other substantially in a straight line 38.

As shown in FIG. 2, when the overhead door is opened or raised to a fully "up" position, the wheel-support portion 22 of the roller assembly 12 moves further to the right into the horizontal track portion 52. When this action occurs, the link portion 16, the pivot assembly 20 and the push/pull assembly 18 all move to the right in the direction of or along the horizontal track portion 52. As the overhead door is pulled into an open or "up" position, the top panel 44 is pulled into the horizontal orientation. As the overhead door is opened or raised more fully, additional panels are oriented horizontally as shown in FIG. 2. As the top panel 44 moves to a horizontal orientation, the angle between the first side 32 of the push/pull assembly 18 and the link portion 16 changes because the push/pull assembly rotates around the corner of the track (i.e. the push/pull assembly rotates about the transverse axis defined by the pivot assembly) whereas the roller assembly moves to the right along the horizontal portion of the track. Thus, when the top panel 44 is oriented horizontally, the link-to-first-side orientation angle 40 is an oblique angle which is a smaller angle than the oblique extension angle 30.

Turning now to FIGS. 5–9, there is shown an alternatively preferred embodiment of the present invention. As in the prior embodiment of FIGS. 1–4, the alternatively preferred embodiment generally comprises a roller bracket apparatus 100 including a roller assembly 120 which, in turn, includes a carriage portion 140 and a link portion 160 projecting from the carriage portion 140. As will be explained in greater detail below, a somewhat modified push/pull assembly 180 is provided, and a pivot assembly 200 is connected between the link portion 160 of the roller assembly 120 and the push/pull assembly 180. The carriage portion 140 includes a wheel-support portion 220 and a plurality of axle/wheel assemblies supported by the wheel-support portion 220. Each of the axle/wheel assemblies includes an axle 260 and a roller wheel 280 connected to the axle 260 by means of a suitable nut fastener or the like (not labeled). The link portion 160 extends from the plane common to the top surface of the carriage portion 140 at an acute extension angle 30*a*. In these respects, the alternatively preferred embodiment is generally similar to the prior embodiment.

Figure 9:
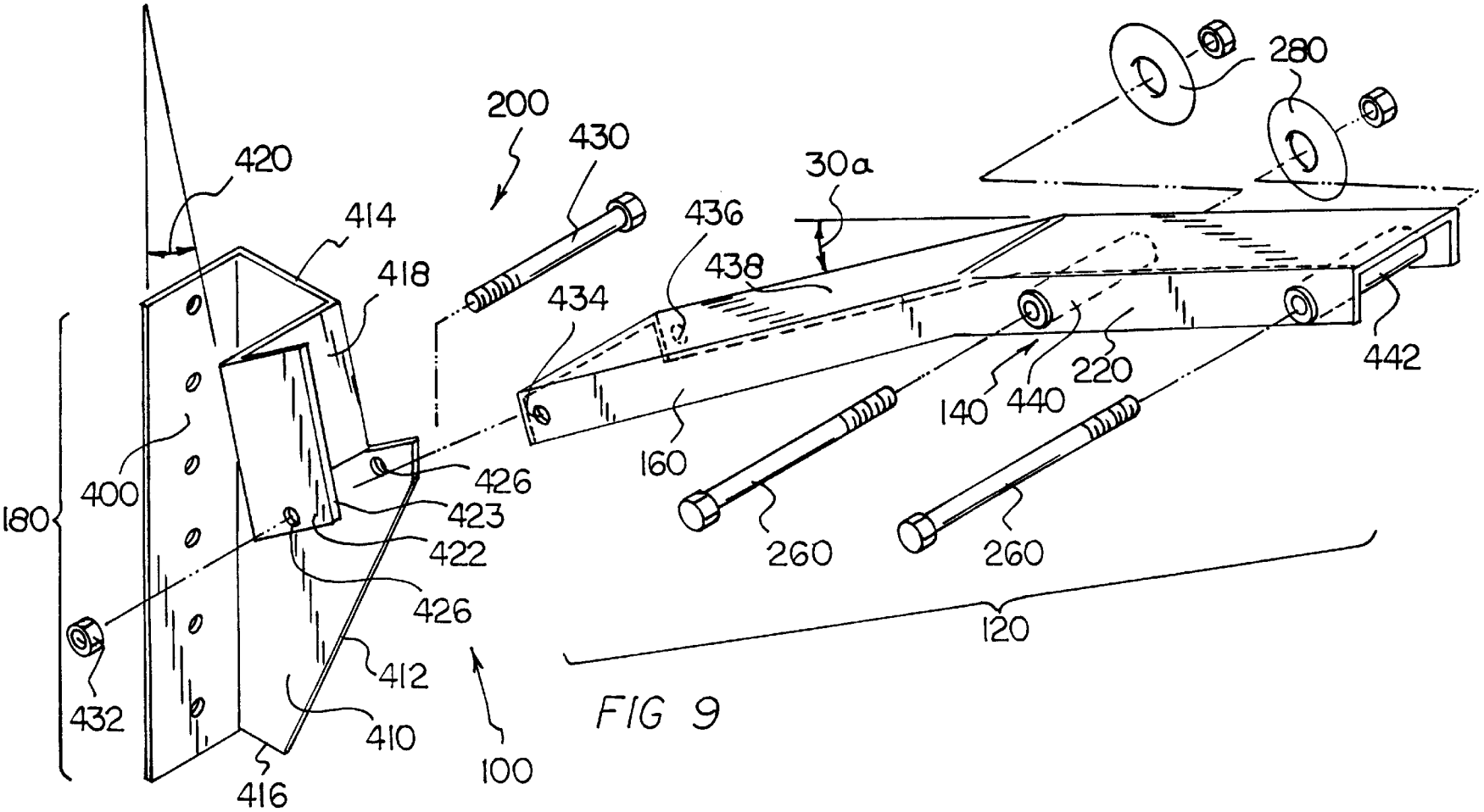
FIG. 9 is an exploded perspective assembly view of the alternatively preferred embodiment of the invention shown in FIGS. 5–8 hereof.

In accordance with the alternatively preferred embodiment of FIGS. 5–9 however, the link portion 160 is pivotally connected to an improved somewhat modified push/pull assembly 180. As best seen in FIGS. 7–9, push/pull assembly 180 comprises a first side portion 400 orthogonally joined to a gusset plate portion 410 which in turn, is bounded by an angled side edge 412, a top edge 414, and a bottom edge 416. The upper portion of the gusset plate portion has integrally joined thereto, substantially as shown, a generally flat, rectangular bearing surface portion 418 the plane of which extends at an acute angle 420 to the plane common to the first side portion 400. Angle 420 is substantially equal to angle 30*a* as will be made more apparent below. The left-most edge of bearing surface portion 418 has integrally joined thereto an orthogonally extending rectangularly-shaped side plate portion 422 having a front edge 423 extending generally parallel to the plane of bearing surface portion 418. A pair of aligned apertures or openings 424, 426 provided respectively in the bottom portion of side plate portion 422 and in the gusset plate portion 410 proximal to the top of angled edge 412, is adapted to axially receive therein pivot axle 430, which in turn, is adapted to be maintained in place by a nut fastener 432. Axle 430 and nut fastener 432 comprise the aforementioned pivot assembly 200.

Figure 6:
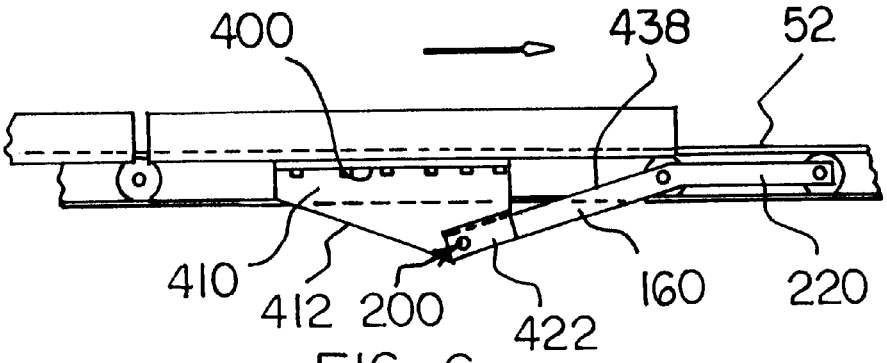
FIG. 6 is a side view showing the alternatively preferred embodiment of the invention of FIG. 1, showing more of the horizontal portion of the roller track, in a position wherein the overhead door is in either a partially or fully open or "up" position.

In another departure from the prior embodiment of FIGS. 1–4, roller assembly 120 takes the form of a unitary elongated member having a U-shaped transverse cross-sectional shape along its entire longitudinal extent and features a medial transverse bend substantially as depicted to define at one end thereof the wheel support portion 220 and at the other opposed end thereof the link portion 160, with the transverse bend being such that a plane common to the top surface 438 of link portion 160 makes the aforementioned acute angle 30*a* with respect to a plane common to the top surface of wheel support portion 220. Proximal to the end of link portion 160, as viewed in FIG. 9, is a pair of aligned apertures 434, 436 disposed in the opposed sides of the link portion respectively, which apertures have substantially the same diameter as openings 424, 426. It will be appreciated that when apertures 424, 434, 436 and 426 are axially aligned and pivot axle 430 is affixed in place in axial extent through these apertures (FIGS. 5–8), link portion 160 is pivotally attached to push/pull assembly 180 via pivot assembly 200, and the push/pull assembly is adapted to rotate relative to link portion 160 about a transverse axis defined by the central longitudinal axis of pivot axle 430. Hence, push/pull assembly 180 is capable of pivoting relative to link portion 160 and wheel support portion 220 (i.e. roller assembly 120) between a door "down" condition (FIG. 5) and a door "up" condition (FIG. 6). Stated otherwise, when the roller assembly 120 is caused to move rearwardly (to the right as viewed in FIGS. 5 and 6), the push/pull assembly 180 (as well as gusset plate portion 410 and bearing surface portion 418) rotates clockwise until bearing surface portion 418 engages the top surface 438 of link portion 160 (FIG. 6) at which juncture the plane common to first side 400 will lie substantially parallel to the plane common to the top surface of wheel support portion 220. Because the angled top surface 438 of link portion 160 serves as a limit stop for the complimentary angled bearing surface portion 418 of the push/pull assembly, and the fact that angle 420 is substantially equal to angle 30*a*, the push/pull assembly 180 and the roller assembly 120 will remain in a straight or aligned condition as the roller assembly travels along the path defined by horizontal portion 52 of the overhead track until the roller assembly ultimately reaches its extreme limit of movement corresponding to a door "up" condition. This limit stop action, according to the alternatively preferred embodiment of the invention as disclosed herein, minimizes undesirable torquing forces imposed upon wheel assemblies 280 tending to twist them out of alignment with the track, and generally provides a stronger pivotal connection between the push/pull assembly and the roller assembly leading to greater reliability and longer wear. Additionally, it will be noted that side plate portion 422 which extends generally parallel to gusset plate 410 serves yet as a further stabilizing means because it is adapted to engage the proximal confronting sidewall of link portion 160 to further resist lateral forces and assures alignment of the parts as they move along the horizontal track portion 52.

Preferably, cylindrical axle housings 440 and 442 extending transversely between the opposed sides of wheel support portion 220 may be provided to house the wheel assembly axles 260, substantially as shown in FIG. 9.

The components of the roller bracket apparatus for an overhead door of the invention can be made from inexpensive and durable metal and plastic materials.

As to the manner of usage and operation of the various embodiments of the instant invention, the same is apparent from the above disclosure, and accordingly, no further discussion relative to the manner of usage and operation need be provided.

It is apparent from the above that the present invention accomplishes all of the objects set forth by providing a new and improved roller bracket apparatus for an overhead door that is low in cost, relatively simple in design and operation, and which may advantageously be used without using low headroom tracks. With the invention, a roller bracket apparatus for an overhead door is provided which does not employ known top brackets that are employed with overhead doors for which several inches have been cut from the bottoms of vertical portions of the roller tracks. With the invention, a roller bracket apparatus for an overhead door is provided which permits a vertical height for headroom space to be less than six inches. With the invention, a roller bracket apparatus for an overhead door is provided which permits the vertical height of headroom space to be no higher than the vertical distance required by the horizontal portions of roller tracks. With the invention, a roller bracket apparatus for an overhead door is provided which does not include door-pulling gear located above the horizontal portions of roller tracks. With the invention, a roller bracket apparatus for an overhead door is provided which avoids the use of stationary, direction-changing corner wheels.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A roller bracket apparatus for use on a track having a vertical portion, a curve, and a horizontal portion, said apparatus comprising:

a roller assembly adapted for movement along said horizontal track portion and which includes a carriage portion and a link portion projecting from said carriage portion, a push/pull assembly adapted for movement along said track, and a pivot assembly connected between said link portion of said roller assembly and said push/pull assembly, wherein said push/pull assembly includes a first angled portion defining a first bearing surface and where said link portion defines a second angled portion defining a second bearing surface such that movement of said roller assembly and said push/pull assembly along said track causes rotation of said push/pull assembly relative to said roller assembly as said push/pull assembly travels along said curve and said roller assembly travels along said horizontal portion sufficient to cause said first bearing surface to engage said second bearing surface whereby to stop further relative rotation between said push/pull assembly and said roller assembly as said push/pull assembly and said roller assembly travel further along said horizontal portion.

2. The apparatus of claim 1 wherein said carriage portion includes:

a wheel-support portion, and a plurality of axle/wheel assemblies supported by said wheel-support portion.

3. The apparatus of claim 2 wherein each of said axle/wheel assemblies includes an axle and a roller wheel connected to said axle.

4. The apparatus of claim 1 wherein said link portion extends from said carriage portion at an acute extension angle.

5. The apparatus of claim 1 wherein said push/pull assembly includes:

a first side portion connected to an article moving along said track, a second portion connected to said first side portion and said pivot assembly, said second side portion comprising means for supporting said angled portion defining a first bearing surface.

6. The apparatus of claim 5 wherein said second portion is a gusset plate orthogonally connected to said first side portion.

7. The apparatus of claim 6 wherein said gusset plate is orthogonally joined to said angled portion defining a first bearing surface and said angled portion makes an acute angle with respect to said first side portion.

8. The apparatus of claim 7 wherein said last-mentioned acute angle is complementary to said acute extension angle.

9. The apparatus of claim 8 wherein said last-mentioned acute angle is substantially equal to said acute extension angle.

10. The apparatus of claim 7 wherein said second angled portion defining a second bearing surface includes a sidewall portion, and said apparatus further includes lateral stabilizing means extending from said first angled bearing surface portion in a direction parallel to said gusset plate for engaging said sidewall portion.

* * * * *